US007184926B2

(12) United States Patent
Jarrott

(10) Patent No.: US 7,184,926 B2
(45) Date of Patent: Feb. 27, 2007

(54) METHOD FOR ESTIMATING THE ORIENTATION OF A MACHINE

(75) Inventor: Nancy Chi-Ling Jarrott, Christchurch (NZ)

(73) Assignee: Trimble Navigation Limited, Sunnyvale, CA (US)

( * ) Notice: Subject to any disclaimer, the term of this patent is extended or adjusted under 35 U.S.C. 154(b) by 103 days.

(21) Appl. No.: 11/081,972

(22) Filed: Mar. 16, 2005

(65) Prior Publication Data

US 2006/0212172 A1 Sep. 21, 2006

(51) Int. Cl.
*G06F 15/00* (2006.01)
*G01C 17/00* (2006.01)
*E02F 3/76* (2006.01)

(52) U.S. Cl. ..... 702/150; 702/151; 702/152; 702/153; 172/4.5; 701/1

(58) Field of Classification Search ..... 702/150, 702/151, 152, 153, 94, 95; 172/1, 2, 4.5; 701/1, 4, 5; 318/139, 489; 37/232, 241, 37/348; 342/357.11
See application file for complete search history.

(56) References Cited

U.S. PATENT DOCUMENTS

| | | | | |
|---|---|---|---|---|
| 5,471,391 | A | 11/1995 | Gudat et al. | |
| 5,477,459 | A | 12/1995 | Clegg et al. | |
| 5,964,298 | A | 10/1999 | Greenspun | |
| 6,088,644 | A * | 7/2000 | Brandt et al. | 701/50 |
| 6,655,465 | B2 * | 12/2003 | Carlson et al. | 172/4.5 |
| 2003/0048220 | A1 * | 3/2003 | Gounon | 342/357.11 |

* cited by examiner

*Primary Examiner*—Bryan Bui

(57) ABSTRACT

A method for estimating the orientation of the machine which provides a motive power unit and a working tool, in which the working tool is pivoted to the motive power unit and carries a 3D sensor and a rotational angle sensor; the method includes collecting a buffer of positional data points from the 3D sensor and fitting these points to a circle; the method also may be used to provide computer control of the machine.

14 Claims, 5 Drawing Sheets

METHOD FOR ESTIMATING THE ORIENTATION OF A MACHINE

TECHNICAL FIELD

The present invention relates to a method of estimating the orientation of a machine, which incorporates a pivoted working tool, from the dimensions of the machine and from information gathered from sensors on the machine.

The present invention further relates to a method of estimating the orientation of the working tool itself, from the orientation of the machine plus information from a rotational angle sensor which measures the angle between the working tool and the machine.

As used herein, the term "orientation" of a component means the direction the component is facing at a given time with respect to a fixed frame of reference. The fixed frame of reference could comprise, for example, the points of the compass, or an arbitrary predetermined reference direction and reference point.

The term "heading" of a component means the direction of travel of that component at a given time with respect to the fixed frame of reference.

The term "trajectory" of a component means the path that component will take over an extended period of time with respect to the fixed frame of reference.

BACKGROUND ART

Operations such as road making and terrain forming require the use of special equipment and the ability to precisely monitor and control the location and orientation of such equipment. Typical of such special equipment is a machine which provides a motive power unit upon which is mounted a pivoted working tool such as a scraper blade, rake, or bucket. The most commonly used special equipment of this type is a grader, which comprises a body which includes a motive power unit, and a pivoted working tool. The present invention will be described with special reference to a grader, but it should be appreciated that the method of the invention is in no way limited to a grader, but is applicable also to any machine of the above described type, such as bulldozers.

When ground is being worked with machines of this type, it is the location and orientation of the motive power unit and the working tool which determine which part of the terrain will be formed. For example, in the case of a grader, the orientation and trajectory of the grader blade will determine where from, and in which direction, earth is moved. In the past the orientation of the working tool and the orientation of the axis of the machine have been determined by eye by the driver, based on experience. However, this means that the quality of the finished work is very dependant on the skill of the driver, and in an effort to achieve more predictable results, there has been a recent move to provide automated assistance to the driver. In order to monitor the location and orientation of the motive power unit and the working tool at all times, a number of sensors may be used. For example, a 3D sensor such as a Global Positioning System (GPS) or robotic total station (RTS) target may be positioned at each end of the working tool. From the combination of this data, the heading of the working tool and the orientation of the motive power unit and of the working tool can be determined by various methods.

Alternatively, the combination of a rotational sensor, placed where the working tool connects to the motive power unit in order to measure the angle between the two, and a single 3D sensor on the working tool may be used, but this gives a significantly less accurate result.

In practice, RTS is preferred to GPS because it gives more accurate results on the scale of use. RTS uses a target on the working tool, which has one or more prisms to reflect light back to the instrument for measurement. As the RTS target moves, servos turn the instrument to automatically keep track of the target. RTS measures both angles in the horizontal plane and the elevation of the target. It has an electronic distance meter which can precisely measure the distance from the instrument to the target using laser technology.

The use of multiple 3D sensors increases the cost of the equipment, and can also give rise to problems such as incorrect target recognition or interference between the 3D sensors. Therefore it is desirable for improved accuracy (as well as for economy) to reduce the number of 3D sensors needed.

A 3D sensor at only one end of the working tool will provide sufficient information to calculate the orientation of the machine when the machine is travelling in a straight line. In this case, the machine orientation is the same as the machine heading, and is parallel to the heading of the working tool. However, the known model, which utilises only a straight-line fit, breaks down when the machine trajectory changes from a straight line to a curve. In practice, the machine trajectory seldom is restricted to a straight line:—typically, a machine such as a grader moves in a complex trajectory which incorporates many curves. For this type of work, the known model gives very poor accuracy.

DISCLOSURE OF INVENTION

It is an object of the present invention to provide a method for estimating the orientation of a machine which incorporates a pivoted working tool, using a fixed reference point on the machine plus information from a rotational sensor and a single 3D sensor, both mounted on the working tool, to an improved level of accuracy.

The present invention provides a method for estimating the orientation of a machine which provides a motive power unit and a working tool, using a fixed reference point on the machine wherein:

(a) a working tool is attached to the motive power unit by a pivot which is located a first distance in front of the fixed reference point;

(b) a 3D sensor is positioned on the working tool at a second distance along the working tool from the pivot;

(c) a rotational angle sensor is adapted to measure a first angle, being the angle between the working tool and an axis of the machine; characterised in that the method includes the steps of:

(i) collecting a buffer of a predetermined number of the most recent positional data points from the 3D sensor;

(ii) fitting the data points to a circle;

(iii) determining the radius and centre of the circle;

(iv) estimating the heading of the 3D sensor;

(v) calculating an estimated orientation of the machine using the estimated heading of the 3D sensor.

In another form of the invention, the present invention provides a method for estimating the orientation of a machine which provides a motive power unit and a working tool, using a fixed reference point on the machine wherein:

(a) a working tool is attached to the motive power unit by a pivot which is located a first distance in front of the fixed reference point;

(b) a 3D sensor is positioned on the working tool at a second distance along the working tool from the pivot;

(c) an angle sensor is adapted to measure a first angle, being the angle between the working tool and an axis of the machine; characterized in that the method includes the steps of:

(i) collecting a buffer of a predetermined number of the most recent positional data points from the 3D sensor;

(ii) fitting the data points to a circle;

(iii) determining the radius and centre of the circle;

(iv) calculating a first vector tangential to the circle at the most recent data point, said first vector being an estimated heading of the 3D sensor;

(v) defining a second vector from the centre of the circle to the fixed reference point;

(vi) defining a third vector from the centre of the circle to the most recent data point;

(vii) calculating a second angle, being the angle between the second vector and the third vector;

(viii) calculating a third angle, being the difference between the first angle and the second angle, which is the difference between the orientation of the machine and the heading of the 3D sensor;

(ix) calculating an estimated orientation of the machine using the estimated heading of the 3D sensor and the third angle.

Since any curve can be defined by a series of straight lines and circles having different radii and centres, this method, combined with the known art, allows the calculation of the orientation of a machine with much greater accuracy than a pure straight-line model.

The present invention further provides a method for estimating the orientation of a working tool, wherein the working tool is pivotally attached to a motive power unit of a machine, characterised in that the method includes the steps of:

a) carrying out the method as described above to estimate the orientation of the machine;

b) using the estimated machine orientation and the measured angle between the working tool and an axis of the machine to estimate the orientation of the working tool.

The present invention also provides a method for controlling a machine which provides a motive power unit and a working tool, comprising the steps of:

a) estimating the orientation of the machine and of the working tool using the method as described above;

b) providing a computer adapted to control the trajectory of the machine and the trajectory of the working tool;

c) providing to the computer a three-dimensional model of a desired terrain to be formed by the machine;

d) using the computer to compare the estimated orientation of the machine and of the working tool with the model of the desired terrain and adjusting the trajectory of the machine and/or the trajectory of the working tool as necessary to achieve formation of the desired terrain.

The present invention further provides a method for estimating the position of a pre-selected point on a working tool on a machine wherein:

(a) the working tool is attached to the motive power unit by a pivot which is located a first distance in front of a fixed reference point;

(b) a 3D sensor is positioned on the working tool at a second distance along the working tool from the pivot;

(c) an angle sensor is adapted to measure a first angle, being the angle between the working tool and an axis of the machine;

(d) the pre-selected point is a third distance along the working tool from the 3D sensor;

characterized in that the method includes the steps of:

(i) estimating the orientation of the machine by use of either of the methods described above;

(ii) calculating an estimated position of the pre-selected point using the estimated orientation of the machine, the first angle, the second and third distances, and the most recent position from the 3D sensor.

Preferably, the working tool is a scraper blade, rake or bucket, and the machine is a grader.

Preferably also, the 3D sensor is a global positioning system or a robotic total station.

BRIEF DESCRIPTION OF THE DRAWINGS

By way of example only, a preferred embodiment of the present invention is described in detail with reference to the accompanying drawings in which.

BEST MODE FOR CARRYING OUT THE INVENTION

Figure 1:
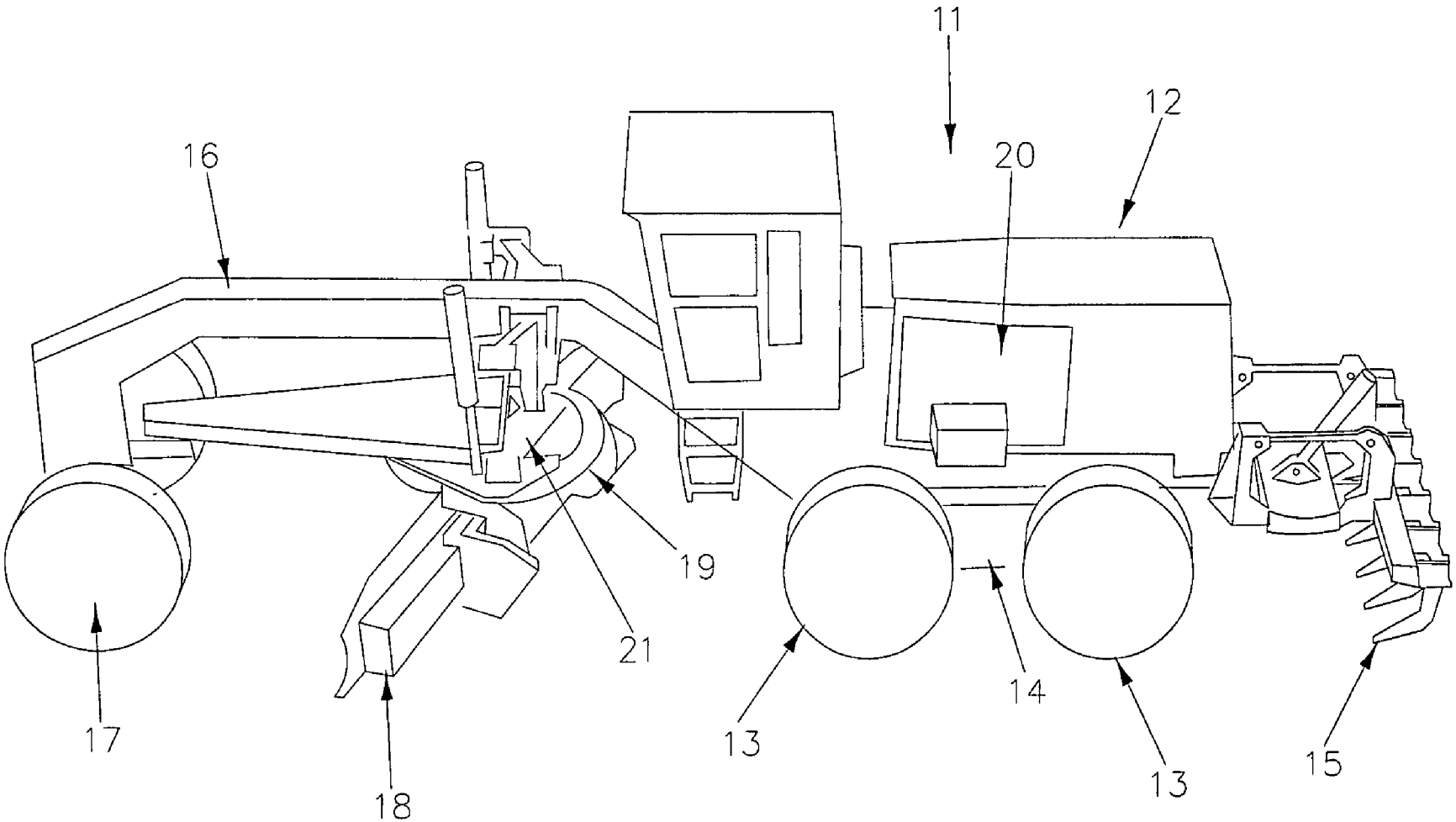
FIG. 1 is a side view of a grader in accordance with the present invention.
Figure 2:
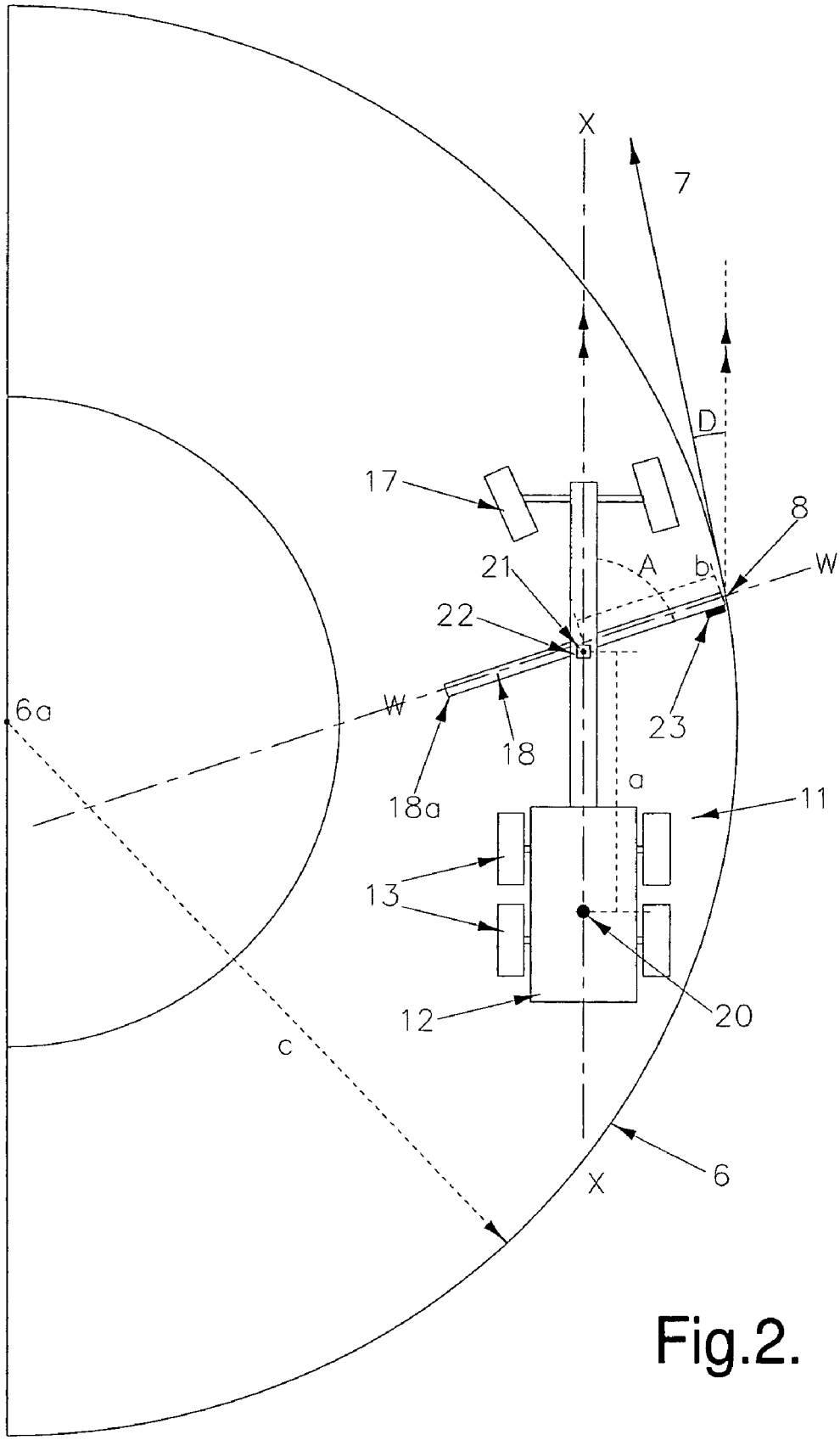
FIG. 2 is a diagrammatic plan view of the grader of FIG. 1, showing the points from which measurements are taken.
Figure 3:
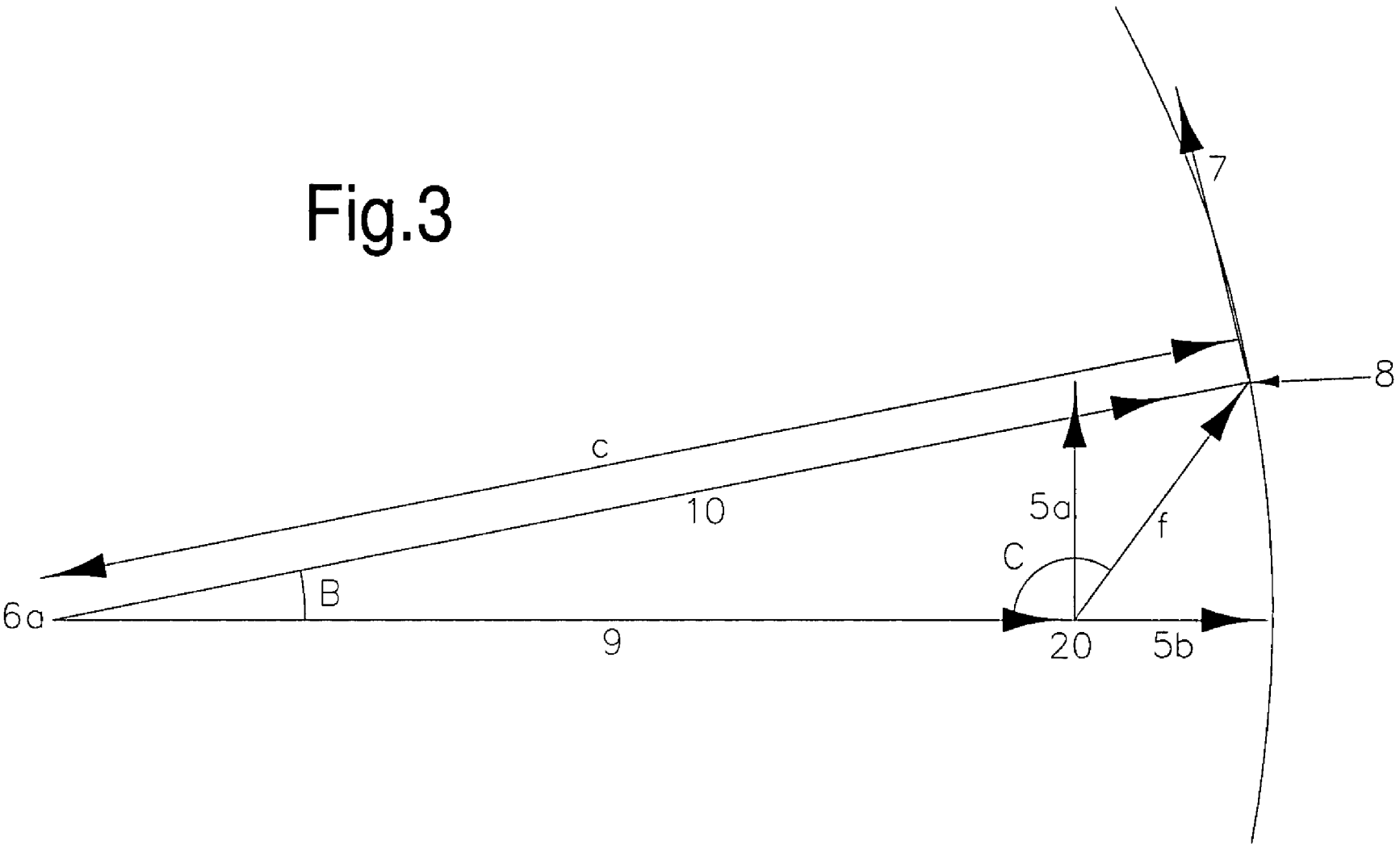
FIGS. 3–4 inclusive show the geometrical constructions required for the calculations.

Referring in particular to FIGS. 1 and 2, the machine depicted is a grader 11 of known type, in which a motive power unit 12 is mounted upon a double set of wheels 13 by means of a walking beam transmission 14. The rear of the grader may optionally support a ripper 15, and the front of the grader comprises a gooseneck connection 16 to a third set of wheels 17; a working tool 18 in the form of a grader blade is mounted below the gooseneck connection 16. The grader working tool 18 is mounted upon a turntable 19. The motion of the working tool 18 is approximated by a rotation in a horizontal plane relative to the longitudinal axis X—X of the grader 11. (FIG. 2).

The longitudinal axis of the working tool 18 is indicated by broken line W—W. (FIG. 2).

The turning point of the grader 11 is determined by the geometry of the motive power unit 12 and the velocity of the grader 11, and generally is between the double set of wheels 13. This is used as the fixed reference point 20.

For purposes of geometrical calculation, the grader working tool 18 can be regarded as pivoting about a central pivot point 21 i.e. the centre of the turntable 19. The pivot point 21 is a first distance a in front of the fixed reference point 20 of the grader 11.

A rotational angle sensor 22 is mounted at the central pivot point 21 and is set up to measure a first angle A, which is the angle between the longitudinal axis W—W of the working tool 18 and the longitudinal axis X—X of the grader 11.

A 3D sensor 23 is located a second distance b along the grader working tool 18 from the central pivot point 21.

The distances a and b are fixed for a specified grader and working tool; the angle A between the longitudinal axes of the working tool 18 and the grader 11 is measured at predetermined time intervals by the rotational angle sensor 22. The overall length of the working tool 18 is known, and the 3D sensor 23 gives the location of that sensor at predetermined time intervals, at a known level of accuracy. From these measurements and readings, and applying the circular model of the present invention, it is possible (as set out in the Example given below) to calculate both the orientation of both the grader 11 and the working tool 18.

EXAMPLE

In a preferred embodiment of the present invention, described with reference to FIGS. 2, 3, 4 and 5, a buffer of data points from the 3D sensor 23 is collected and stored in a computer-accessible data storage device. A new point is added to the buffer if the distance $d_1$, to the newest point in the buffer is greater than 0.2 m. An old point is removed from the buffer if the chord length of the remaining data points is greater than 7.5 m. A computer program (which must be capable of determining lengths and angles and fitting curves to data within specified parameters) is used to analyse the data. If the buffer contains less than 5 m worth of data, a straight line is fitted to the data. If the buffer contains more than 5 m worth of data, a circle 6 (with radius c and centre 6*a*) is fitted to the data. If the circle 6 has a radius c greater than 500 m, a straight line is fitted instead. If the circle fit fails (e.g. because no result is found within the acceptable parameters after the specified number of iterations and the program returns a null result) and the last fitted circle 6*b* has a radius c less than 250 m, the last fitted circle 6*b* is used. If the circle fit fails and the last fitted circle 6*b* has a radius greater than 250 m, a straight line is fitted.

Figure 4:
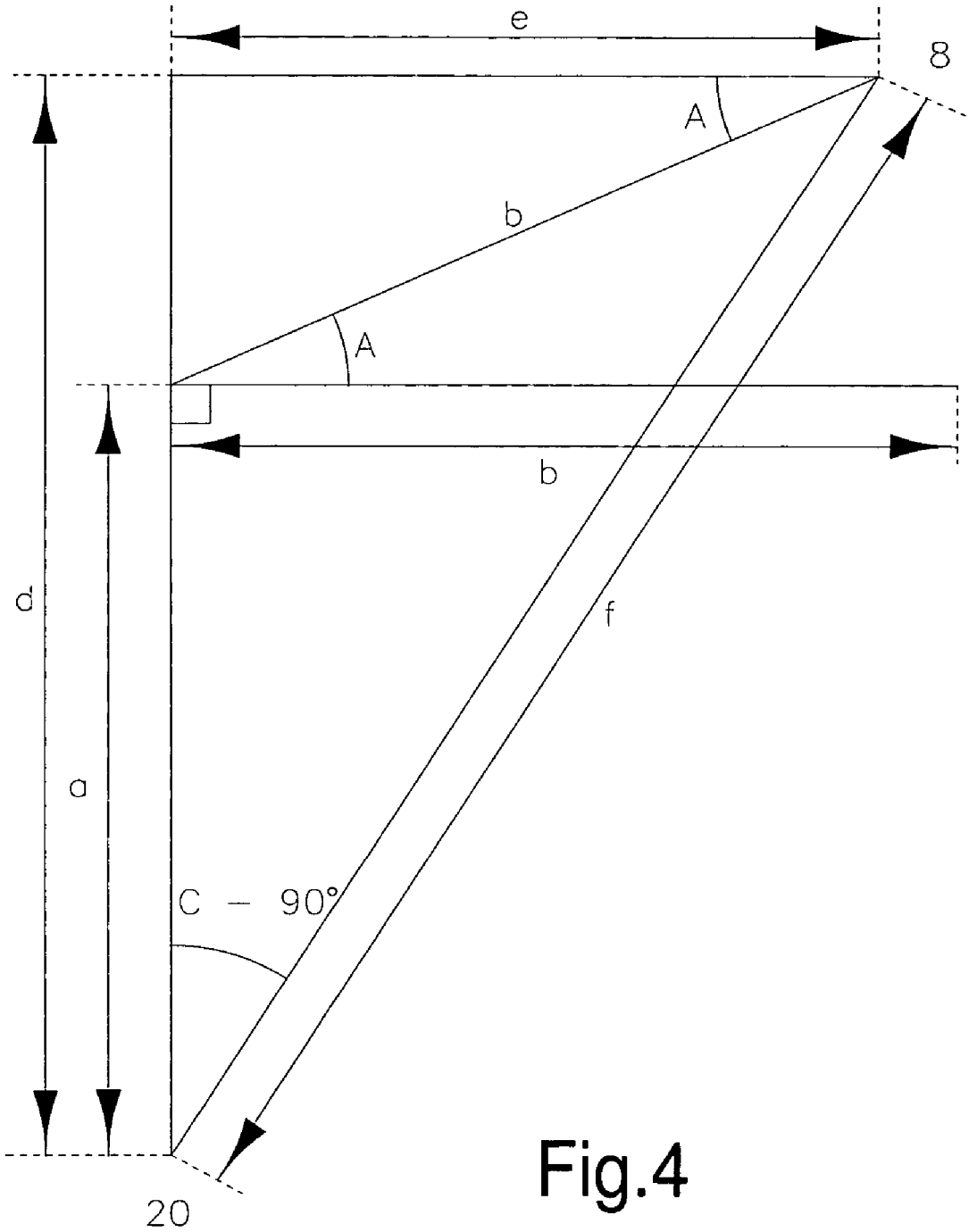
Figure 5:
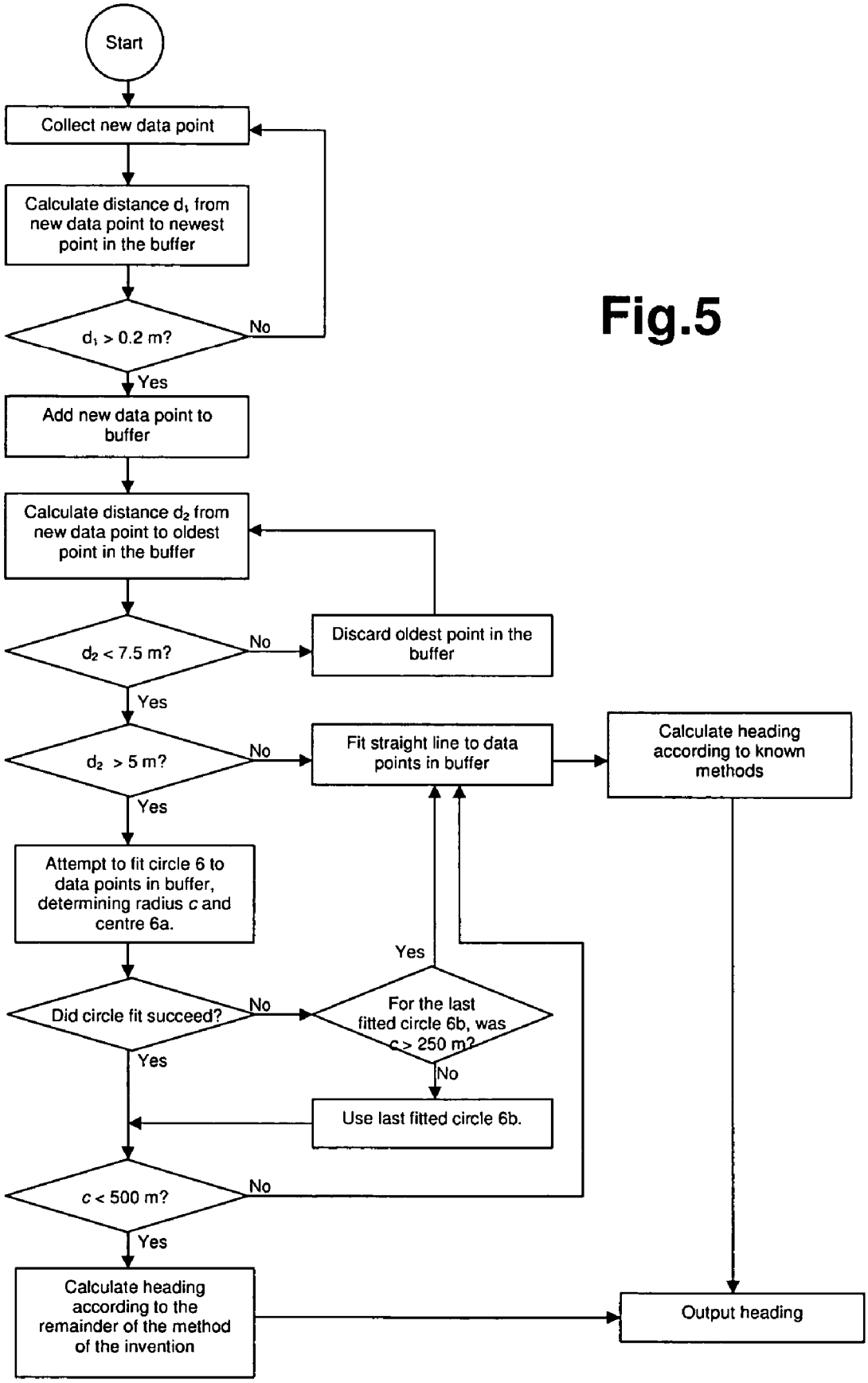
FIG. 5 is a flow-chart showing the method of the present invention.

The heading of the 3D sensor 23 is estimated to be in the direction of a first vector 7 tangential to circle 6 at the most recent data point 8 (the velocity vector of 3D sensor 23). The position of the most recent data point 8 relative to the fixed reference point 20 is defined by perpendicular vectors 5*a* and 5*b*, which have corresponding lengths d and e. (FIG. 4). The distance f between the fixed reference point 20 and the most recent data point 8 is determined by Pythagoras' Theorem to be:

$$f = \sqrt{(d^2 + e^2)} \qquad \text{Equation 1}$$

A second vector 9 extends from the centre 6*a* of the circle 6 to the position of the fixed reference point 20. A third vector 10 extends from the centre 6*a* of the circle 6 to the most recent data point 8 (and therefore has length c). Angle B is the angle between the second vector 9 and the third vector 10.

By use of trigonometry, it is determined that angle C (see FIG. 3) has a value (in radians) of:

$$C \equiv \tan^{-1}\left(\frac{e}{d}\right) + \frac{\pi}{2} \qquad \text{Equation 2}$$

Applying the Compound Angle Rules:

$$\sin(C) = \cos\left(\tan^{-1}\left(\frac{e}{d}\right)\right) \qquad \text{Equation 3}$$

By trigonometry:

$$\tan^{-1}\left(\frac{e}{d}\right) = \cos^{-1}\left(\frac{d}{f}\right) \qquad \text{Equation 4}$$

and $$d = a + b\sin(A) \qquad \text{Equation 5}$$

Combining Equation 3 and Equation 4 gives:

$$\sin(C) = \frac{d}{f} \qquad \text{Equation 6}$$

and combining Equation 5 and Equation 6 gives:

$$\sin(C) = \frac{a + b\sin(A)}{f} \qquad \text{Equation 7}$$

According to the Sine Rule:

$$\frac{\sin(B)}{f} = \frac{\sin(C)}{c} \qquad \text{Equation 8}$$

And therefore, combining Equation 7 with Equation 8 gives:

$$\sin(B) = \frac{a + b\sin(A)}{c} \qquad \text{Equation 9}$$

An angle D is defined as:

$$D = A - B \qquad \text{Equation 10}$$

where the orientation of the axis X—X of the grader 11 is an angle D rotation from the first vector 7. (FIG. 2).

Combining Equation 9 with Equation 10 gives:

$$D = A - \sin^{-1}\left(\frac{a + b\sin(A)}{c}\right) \qquad \text{Equation 11}$$

Substituting the values for lengths a, b and c and angle A into Equation 11 gives the angle D. A rotation of first vector 7 by angle D gives the orientation of the grader.

This calculation is repeated as necessary to obtain a series of orientation readings for the machine. If the orientation of the working tool is required, this may be calculated from the machine orientation and angle A, at any given time.

In practice, data from the sensors is stored in a computer database. A computer program analyses the data to determine within specified parameters (such as those discussed above) whether to fit a straight line or a circle to the buffer of recent data points from the 3D sensor 23. If a straight line is selected as the appropriate fit, standard techniques may be used to fit a straight line to the data. If a circle is selected as the appropriate fit, the method described above is used to determine the orientation of the grader 11 and hence the orientation of the working tool.

The orientation of the grader is calculated at each new data point. Interpolation between the data points allows the mapping of a smooth curve indicating the orientation of the grader at any time.

The position and orientation of the grader are used to determine the trajectory of the machine. This information can be used to predict the position and orientation of the machine at a future time.

The current position of the machine is then compared with a 3D model of the desired terrain. This determines whether the ground at that point needs to be filled or cut. Comparison of this with the predicted future position of the machine indicates what action is required. This information can be either relayed in a graphical form to a manual operator, or entered into a control program for automatic operation of the working tool.

The orientation of the machine can be used to determine further useful information, including the position of the end 18*a* of working tool 18 furthest from the 3D sensor 23 and the path of the working tool 18, by known methods.

Real time accurate analysis of the data using this method and comparison of the plotted real time path of the working tool 18 with the desired path allows for immediate course correction, and/or working tool angle adjustment, either manually or automatically.

This method is an improvement over the previous methods used for determining the orientation of a grader using a single sensor and a straight line only fit. Chart 1 shows the magnitude of the estimated error in the heading of a grader calculated from real results using a straight line algorithm (shown by the dotted line) and the method of the present invention (solid line).

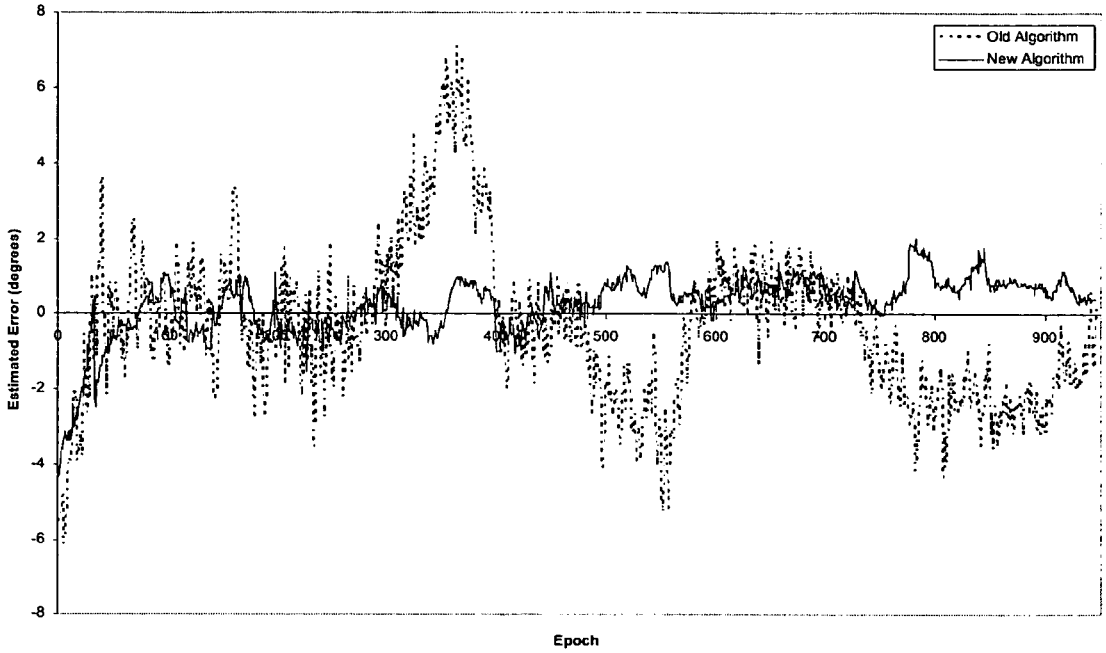
*Chart 1*

These results indicate that the method of the present invention gives results accurate to within one degree approximately 90% of the time for a grader travelling along a smooth trajectory.

The invention claimed is:

1. A method for estimating an orientation of a machine which provides a motive power unit and a working tool, using a fixed reference point on the machine wherein:

(a) a working tool is attached to the motive power unit by a pivot which is located a first distance in front of the fixed reference point;

(b) a 3D sensor is positioned on the working tool at a second distance along the working tool from the pivot;

(c) a rotational angle sensor is adapted to measure a first angle, being the angle between the working tool and an axis of the machine;

characterised in that the method comprises the steps of:

(i) collecting a buffer of a predetermined number of the most recent positional data points from the 3D sensor;

(ii) fitting the data points to a circle;

(iii) determining the radius and centre of the circle;

(iv) estimating an output heading of the 3D sensor;

(v) calculating and providing an estimated orientation of the machine using the estimated output heading of the 3D sensor.

2. A method for estimating the orientation of a working tool, wherein the working tool is pivotally attached to a motive power unit of a machine, characterised in that the method includes the steps of:

a) carrying out the method as claimed in claim 1 to estimate the orientation of the machine;

b) using the estimated machine orientation and the measured angle between the working tool and an axis of the machine to estimate the orientation of the working tool.

3. A method for controlling a machine which provides a motive power unit and a working tool, comprising the steps of:

a) estimating the orientation of the machine and of the working tool using the method as claimed in claim 2;

b) providing a computer adapted to control the trajectory of the machine and the trajectory of the working tool;

c) providing to the computer a three-dimensional model of a desired terrain to be formed by the machine;

d) using the computer to compare the estimated orientation of the machine and of the working tool with the model of the desired terrain and adjusting the trajectory of the machine and/or the trajectory of the working tool as necessary to achieve formation of the desired terrain.

4. A method for estimating the position of a pre-selected point on a working tool on a machine wherein:

(a) the working tool is attached to the motive power unit by a pivot which is located a first distance in front of a fixed reference point;

(b) a 3D sensor is positioned on the working tool at a second distance along the working tool from the pivot;

(c) a rotational angle sensor is adapted to measure a first angle, being the angle between the working tool and an axis of the machine;

(d) the pre-selected point is a third distance along the working tool from the 3D sensor;

characterised in that the method includes the steps of:

(i) estimating the orientation of the machine by use of the method according to claim 1;

(ii) calculating an estimated position of the pre-selected point using the estimated orientation of the machine, the first angle, the second and third distances, and the most recent position from the 3D sensor.

5. The method as claimed in any one of claims 1–4 wherein the working tool is selected from the group consisting of a scraper blade, a rake and a bucket.

6. The method as claimed in any one of claims 1–4 wherein the working tool comprises a scraper blade and the machine is selected from the group consisting of a grader and a bulldozer.

7. The method as claimed in any one of claims 1–4 wherein the 3D sensor is selected from the group consisting of: a global positioning system, a robotic total station.

8. A method for estimating an orientation of a machine which provides a motive power unit and a working tool, using a fixed reference point on the machine wherein:

(a) a working tool is attached to the motive power unit by a pivot which is located a first distance in front of the fixed reference point;

(b) a 3D sensor is positioned on the working tool at a second distance along the working tool from the pivot;

(c) a rotational angle sensor is adapted to measure a first angle, being the angle between the working tool and an axis of the machine;

characterised in that the method comprises the steps of:

(i) collecting a buffer of a predetermined number of the most recent positional data points from the 3D sensor;

(ii) fitting the data points to a circle;

(iii) determining the radius and center of the circle;

(iv) calculating a first vector tangential to the circle at the most recent data point, said first vector being an estimated output heading of the 3D sensor;

(v) defining a second vector from the centre of the circle to the fixed reference point;

(vi) defining a third vector from the centre of the circle to the most recent data point;

(vii) calculating a second angle, being the angle between the second vector and the third vector;

(viii) calculating a third angle, being the difference between the first angle and the second angle, which is the difference between the orientation of the machine and the heading of the 3D sensor;

(ix) calculating and providing an estimated orientation of the machine using the estimated output heading of the 3D sensor and the third angle.

9. A method for estimating the orientation of a working tool, wherein the working tool is pivotally attached to a motive power unit of a machine, characterised in that the method includes the steps of:

a) carrying out the method as claimed in claim 8 to estimate the orientation of the machine;

b) using the estimated machine orientation and the measured angle between the working tool and an axis of the machine to estimate the orientation of the working tool.

10. A method for controlling a machine which provides a motive power unit and a working tool, comprising the steps of:

a) estimating the orientation of the machine and of the working tool using the method as claimed in claim 9;

b) providing a computer adapted to control the trajectory of the machine and the trajectory of the working tool;

c) providing to the computer a three-dimensional model of a desired terrain to be formed by the machine;

d) using the computer to compare the estimated orientation of the machine and of the working tool with the model of the desired terrain and adjusting the trajectory of the machine and/or the trajectory of the working tool as necessary to achieve formation of the desired terrain.

11. A method for estimating the position of a pre-selected point on a working tool on a machine wherein:

(a) the working tool is attached to the motive power unit by a pivot which is located a first distance in front of a fixed reference point;

(b) a 3D sensor is positioned on the working tool at a second distance along the working tool from the pivot;

(c) a rotational angle sensor is adapted to measure a first angle, being the angle between the working tool and an axis of the machine;

(d) the pre-selected point is a third distance along the working tool from the 3D sensor;

characterised in that the method includes the steps of:

(i) estimating the orientation of the machine by use of the method according to claim 8;

(ii) calculating an estimated position of the pre-selected point using the estimated orientation of the machine, the first angle, the second and third distances, and the most recent position from the 3D sensor.

12. The method as claimed in any one of claims 8–11 wherein the working tool is selected from the group consisting of a scraper blade, a rake and a bucket.

13. The method as claimed in any one of claims 8–11 wherein the working tool comprises a scraper blade and the machine is selected from the group consisting of a grader and a bulldozer.

14. The method as claimed in any one of claims 8–11 wherein the 3D sensor is selected from the group consisting of: a global positioning system, a robotic total station.

* * * * *